United States Patent [19]

Wallen et al.

[11] 4,299,850

[45] Nov. 10, 1981

[54] PACKAGE FOR FRAGILE FOOD ITEMS

[75] Inventors: Fred L. Wallen, Appleton, Wis.; Edward Huxel, Chatsworth, Calif.

[73] Assignee: American Can Company, Greenwich, Conn.

[21] Appl. No.: 140,239

[22] Filed: Jan. 14, 1980

[51] Int. Cl.[3] ..... B65B 23/00

[52] U.S. Cl. ..... 426/124; 206/45.14; 206/45.19; 206/45.33; 206/499; 206/521; 206/585; 426/106; 426/128; 229/87 F

[58] Field of Search ..... 426/124, 128, 396, 119, 426/106; 206/516, 585, 499, 521, 586, 587, 588, 591, 592, 45.19, 482, 483, 495, 447, 448, 45.14, 45.34, 497, 45.33; 229/87 F

[56] References Cited

U.S. PATENT DOCUMENTS

| | | | |
|---|---|---|---|
| 2,034,809 | 3/1936 | Grant | 426/128 |
| 2,306,624 | 12/1942 | Harris | 426/119 |
| 3,178,018 | 4/1965 | Bruun | 206/499 |
| 3,393,076 | 7/1968 | Moyer et al. | 426/119 |
| 3,746,156 | 7/1973 | Austin | 206/45.19 |
| 3,896,928 | 7/1975 | Forte | 206/45.14 |
| 3,901,382 | 8/1975 | Roceaforte | 206/45.19 |
| 4,018,905 | 4/1977 | Adamek et al. | 426/128 |
| 4,055,670 | 10/1977 | Belmont | 426/119 |
| 4,173,655 | 11/1979 | Capo | 206/45.14 |

FOREIGN PATENT DOCUMENTS

| | | | |
|---|---|---|---|
| 897548 | 5/1962 | United Kingdom | 206/516 |

*Primary Examiner*—Steven L. Weinstein

*Attorney, Agent, or Firm*—Robert P. Auber; Thomas D. Wilhelm

[57] ABSTRACT

A package for protecting fragile food items against damage in commerce. The package includes a tray being formed with a cutout defining a saddle and a return bend portion defining a slot having a retaining wall and a plurality of nested, generally U-shaped pastry units associated with the tray saddle and slot. The tray and pastry units being enclosed within an outer plastic film.

9 Claims, 6 Drawing Figures

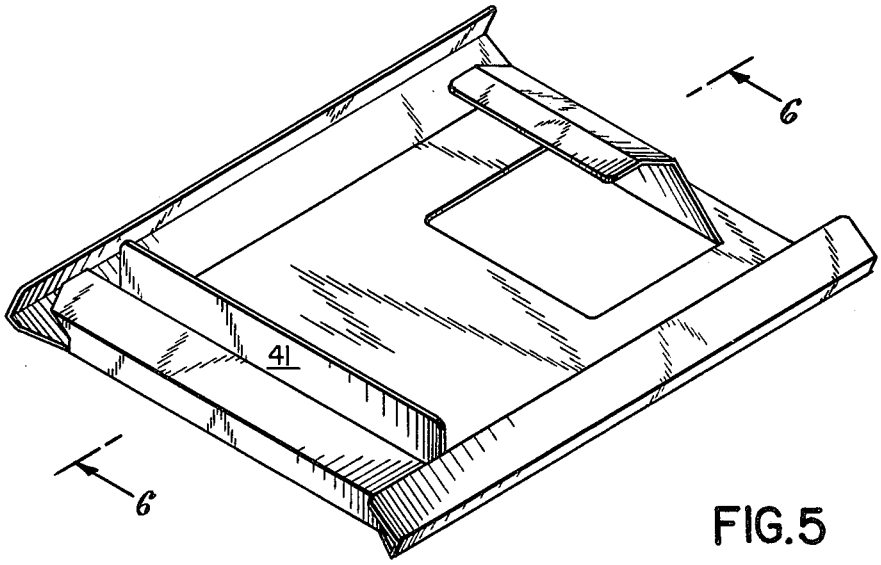
FIG.5
FIG.6
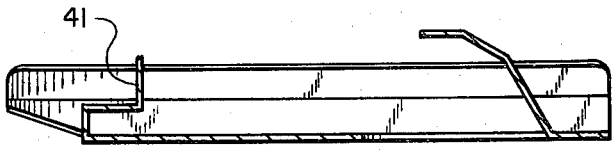

PACKAGE FOR FRAGILE FOOD ITEMS

BACKGROUND OF THE INVENTION

The present invention relates to packaging and relates in particular to a package operable to contain a fragile item of food while protecting the food from damage that would otherwise occur during the normal wear and tear in marketing.

It is a feature of the present invention to provide a package for containing a plurality of crisp, fragile pastry shells or pastry units most commonly used in making a so-called taco sandwich.

It is a further feature of the invention to provide a package for pastry units of the class described which provides protection against damage resulting from dropping the package.

It is a still further feature of the invention to provide a package which provides protection against compressive loads tending to chip, break or crush fragile pastry shells or pastry units.

SUMMARY OF THE INVENTION

A package embracing certain features of the present invention and useful to protect fragile items of food against damage in commerce may comprise, in combination, a tray and a plurality of generally U-shaped, crisp, relatively thin pastry units, each unit defining a pair of spaced wings joined by a contiguous web, said tray being formed with a cut-out defining a saddle and a return bend portion defining a slot having a retaining wall, a plurality of said units being nested so that one unit is received snugly within another with its external surface being received within and in contact with the internal surface of the next outermost unit, said nested units being positioned on said tray so that corresponding wings of nested units are received within said slot projecting toward said retaining wall while the web of the outermost unit is seated upon and retained by said saddle whereby said units are fixed to and supported by said tray.

Other features and advantages of the present invention will become more apparent from an examination of the succeeding specification when read in conjunction with the appended drawings, in which;

BRIEF DESCRIPTION OF THE DRAWINGS

FIG. 5 is a view similar to FIG. 2 showing an alternative embodiment, and, FIG. 6 is a vertical section of FIG. 5 as viewed in the plane indicated by the line 6—6 and in the direction indicated by the arrows.

DESCRIPTION OF PREFERRED EMBODIMENT

Figure 1:
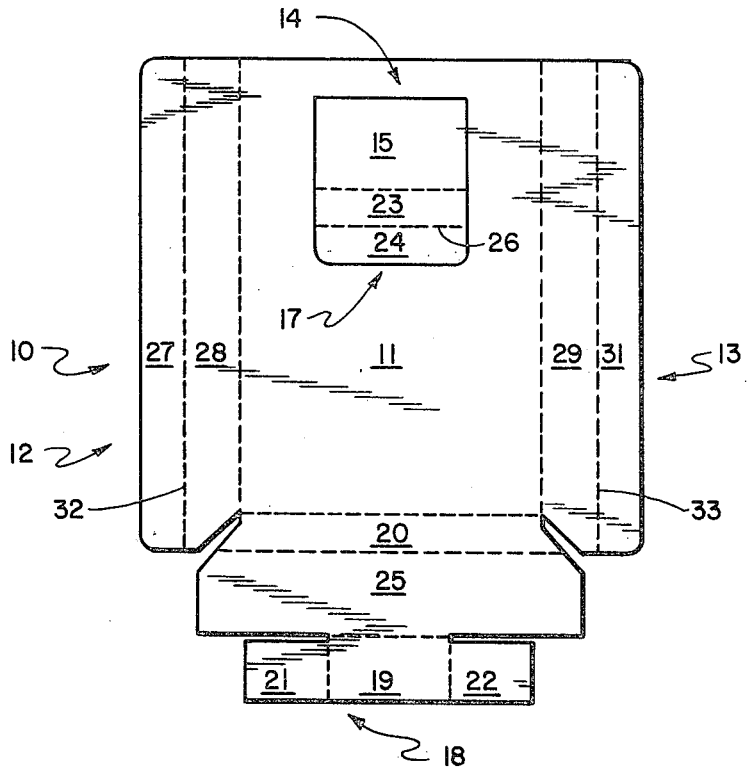
FIG. 1 is a plan view of a typical blank from which the tray portion of the present invention is fabricated.
Figure 2:
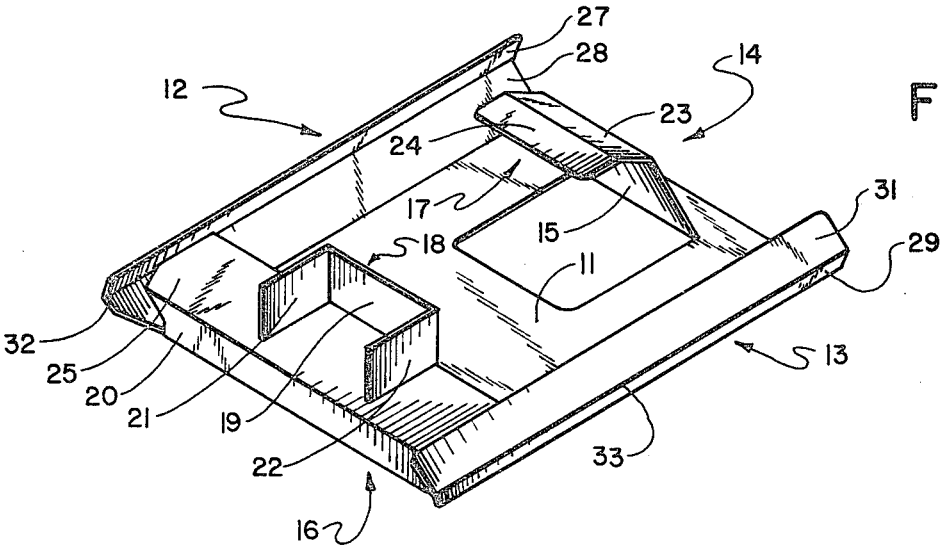
FIG. 2 is a perspective view of the blank of FIG. 1 in the fabricated condition with the pastry units removed.

Referring now in detail to FIGS. 1 and 2, the reference numeral 10 indicates generally a blank of paperboard material cut and scored to define a planar body

11, side walls 12 and 13, saddle 14 and return bend portion 16.

The saddle 14, having main body 15, terminates in a tab indicated generally by the reference numeral 17; the return bend portion 16, formed with a retaining wall 20 and a top wall 25, is hinged to a spacer indicated generally by the reference numeral 18. The spacer 18 includes a central support 19 and hinged end supports 21 and 22.

Figure 4:
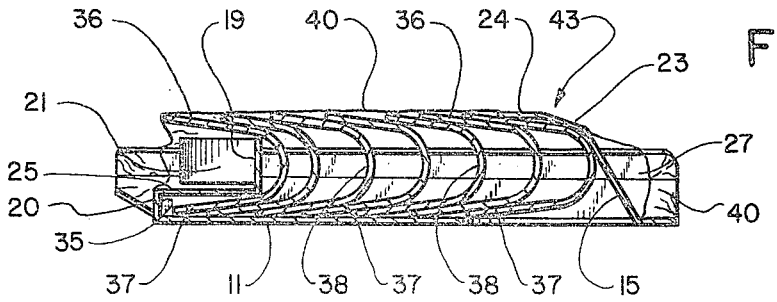
FIG. 4 is a sectional view of FIG. 3 in the plane of the line 4—4 as viewed in the direction of the arrows.

The planar body 11, retaining wall 20 and top wall 25 define a slot 35 as is most apparent in FIGS. 4 and 6.

Note that the hinged tab 17 comprises panels 23 and 24 joined by score line 26; correspondingly, side walls 12 and 13 comprise panels 27 and 28 and panels 29 and 31 joined by score lines 32 and 33, respectively, in a manner and for reasons which will become more apparent as the specification proceeds.

Figure 3:
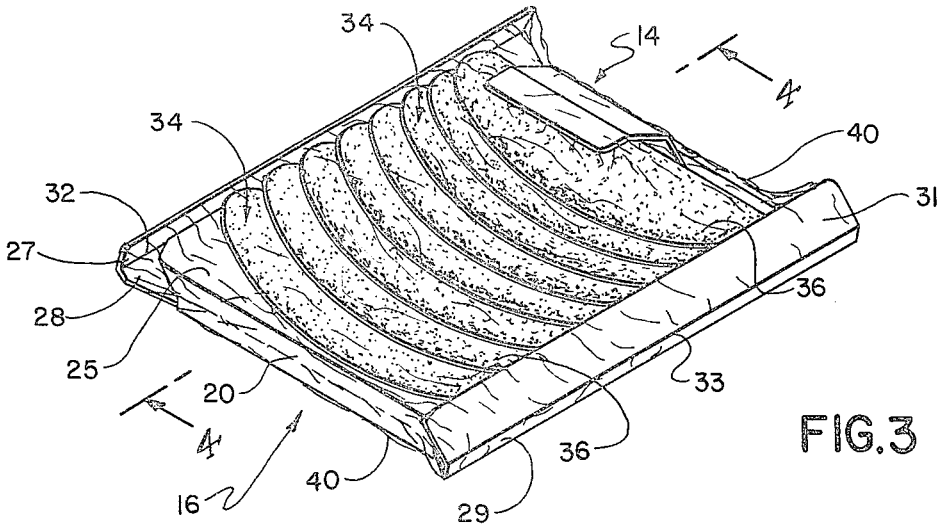
FIG. 3 is a view similar to the illustration of FIG. 2 with the pastry units in place and the package completed and enclosed by a plastic film.

FIGS. 3 and 4 show the completed package in which U-shaped pastry units 34—34 each having spaced wings 36—36 and 37—37, respectively, joined by webs 38—38 are fixed to the fabricated blank.

The outermost web 38 of the outermost pastry unit 34 is in resilient contact with main body 15 of saddle 14 while panels 23 and 24 thereof are held in frictional contact with the outer surface of the outermost pastry unit, as at 43, by the tension of package enveloping film 46.

Note that the wings 37—37 of the innermost pastry units 34—34 are received within slot 35 and project toward retaining wall 20 as is most apparent in FIG. 4.

The very innermost pastry unit straddles spacer 18 in that central support 19 and end supports 21 and 22 are nested within the wings 36 and 37 of the unit which is also apparent in FIG. 4.

The spacer 18 provides resistance to a crushing load tending to collapse opposed wings 36 and 37.

Referring to FIGS. 2 and 3 it is apparent that return bend portion 16 provides resistance to lateral crushing in that top wall 25 thereof engages side walls 12 and 13, specifically at scores line 32 and 33.

At the opposite end of the package resistance to lateral crushing is provided by the nested webs and wings of the pastry 34—34 in contact with the side walls.

FIGS. 5 and 6 show an alternative or secondary embodiment of the invention in which the spacer defines an elongated support 41 without the end supports show in the primary embodiment of FIGS. 1 through 4.

It is anticipated that a wide variety of embodiments of the present invention may be devised without departing from the spirit and scope thereof.

What is claimed is:

1. A package for protecting fragile items of food against damage in commerce comprising, in combination, a tray and a plurality of generally U-shaped, crisp, relatively thin pastry units, each unit defining a first wing and a spaced second wing joined by a contiguous web, said tray being formed with both a cut-out portion comprising an integral saddle including panels and a return bend portion comprising a retaining wall and a top wall defining a slot, a plurality of said units being nested so that one unit is received snuggly within another with its external surface being received within and in contact with the internal surface of the next outermost unit, said nested units being positioned on said tray so that corresponding first wings of the innermost nested units are received within said slot projecting toward said retaining wall while the web of the outermost unit is in resilient contact with said saddle with said panels contacting the outer surface of the second wing of the outermost unit, said tray including a spacer attached to said return bend portion and nested within the space between spaced wings on the innermost unit to provide resistance to a crushing load, said tray and the nested units being enclosed in a plastic film such that said units are fixed to and supported by said tray.

2. The combination of claim 1 in which said tray is fabricated of paper-board.

3. The combination of claim 2 in which said spacer is hinged to the return bend portion of said tray.

4. The combination of claim 3 in which said tray is formed with a pair of opposed sidewalls to provide further resistance to a crushing load.

5. The combination of claim 4 in which said return bend portion engages said opposed side walls to provide resistance to a lateral crushing load.

6. The combination of claim 5 in which said side walls have score lines in angular relationship with said return bend portion and said return bend portion engages said opposed side walls at said side wall score lines.

7. The combination of claim 6 in which said nested webs and wings cooperate with said opposed sidewalls to provide further resistance to a lateral crushing load.

8. The combination of claim 7 in which said spacer includes a central support and at least one hinged end support projecting from said central support.

9. The combination of claim 8 in which said saddle terminates in a hinged tab which cooperates with said plastic film to cause said tab to maintain frictional contact with the outer wing of the outermost unit when the film is drawn.

* * * * *